United States Patent [19]

Bianchi

[11] 3,970,020

[45] July 20, 1976

[54] SEWING THREADS TRIMMING DEVICE FOR SEWING MACHINES

[75] Inventor: Nereo Bianchi, Pavia, Italy

[73] Assignee: Necchi S.p.A., Pavia, Italy

[22] Filed: Apr. 19, 1974

[21] Appl. No.: 462,387

[30] Foreign Application Priority Data

Apr. 27, 1973 Italy ..... 42905/73

[52] U.S. Cl. ..... 112/252

[51] Int. Cl. ..... D05b 65/02

[58] Field of Search ..... 112/252, 130, 129, 122, 112/121.11, 121.12, 121.15

[56] References Cited

UNITED STATES PATENTS

| | | | |
|---|---|---|---|
| 1,292,784 | 1/1919 | Hughes | 112/252 |
| 3,216,380 | 11/1965 | Bono | 112/121.12 |
| 3,276,405 | 10/1966 | Scholl | 112/121.12 |
| 3,605,664 | 9/1971 | Hedegaard | 112/252 |
| 3,776,161 | 12/1973 | Papagewski et al. | 112/252 |

*Primary Examiner*—H. Hampton Hunter
*Attorney, Agent, or Firm*—Stevens, Davis, Miller & Mosher

[57] ABSTRACT

A sewing threads trimming device for sewing machines provided with a blade adapted to make, at the end of a sewing operation and in a suitable timing relation with the hook and needle movements, a first displacement over the hook during which a thread loop closes over the blade and thereafter a second movement in the opposite direction to bring the sewing threads into contact with a counterblade and cut them, including a cam of magnetizable material deriving its motion from the sewing machine main shaft and having a portion of little thickness and an arc-shaped front contour and a second portion diametrically opposed to the first having a particular contour to impart prescribed motion to the threads trimming blade and a cam follower comprised of a U-shaped member closed by a cylindrical portion adapted to couple with the cam and connected to a blade carrying shaft through a plate and crank mechanism. The cam follower is a member of a magnetic circuit energizable by a coil linked thereto to obtain coupling through magnetic attraction between the cam follower and the cam.

4 Claims, 10 Drawing Figures

SEWING THREADS TRIMMING DEVICE FOR SEWING MACHINES

The present invention relates to a sewing threads trimming device for sewing machines and more particularly to a threads trimming blade that, at the end of the sewing operation, makes a first displacement over the hook while the thread-loop closes over the blade and then a second displacement in the opposite direction to bring the sewing threads into contact with a counterblade and cut them.

Threads trimming devices mounted on industrial sewing machines usually are automatically actuated at the end of the sewing with the movement of the trimming member being suitably timed relative to the hook and needle strokes. In the known devices, the drive is imparted in an indirect way to the trimming blade by a little electromagnet, suitably energized, which causes a mechanical coupling between a rotating cam integral with the main shaft of the sewing machine and a cam follower kinematically joined to the blade or, in a direct way by an electromagnetic or pneumatic actuator, the movable member thereof being directly connected to the threads trimming blade. The first type of said devices has the drawback of being structurally complex. In the second type, to the contrary, perfect timing can not be reached between the movements of the blade and those of the stitch forming members, i.e., needle and hook as can be obtained by using a cam rotating in a suitable timing relation with the members.

Therefore, it is an object of the present invention to provide a sewing threads trimming device mounted on an industrial sewing machine which works perfectly and safely and is of a simple structure relative to the threads trimming devices of the same type, already known in the art.

The technical problem to be solved in reaching the object mentioned above was that of deriving the drive for the blade movement directly from a cam means strictly connected in its rotation to a main shaft of the sewing machine.

The resolution of the technical problem is characterized in that the threads trimming device has a cam of magnetizable material deriving its motion from the main shaft of the sewing machine and a cam follower being a part of a magnetic circuit that can be energized by a coil linked thereto to obtain coupling through magnetic attraction between the cam follower and the cam.

Further advantages and features of the invention will be apparent from the following description of a preferred embodiment thereof and from the attached drawings in which.

Figure 1:
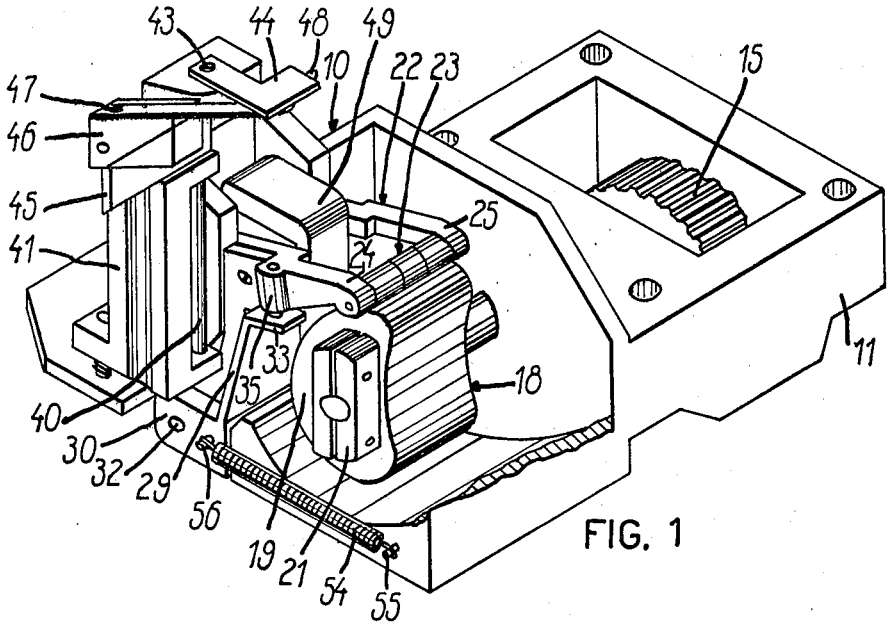
FIG. 1 is a perspective view of the threads trimming device of the present invention.
Figure 2:
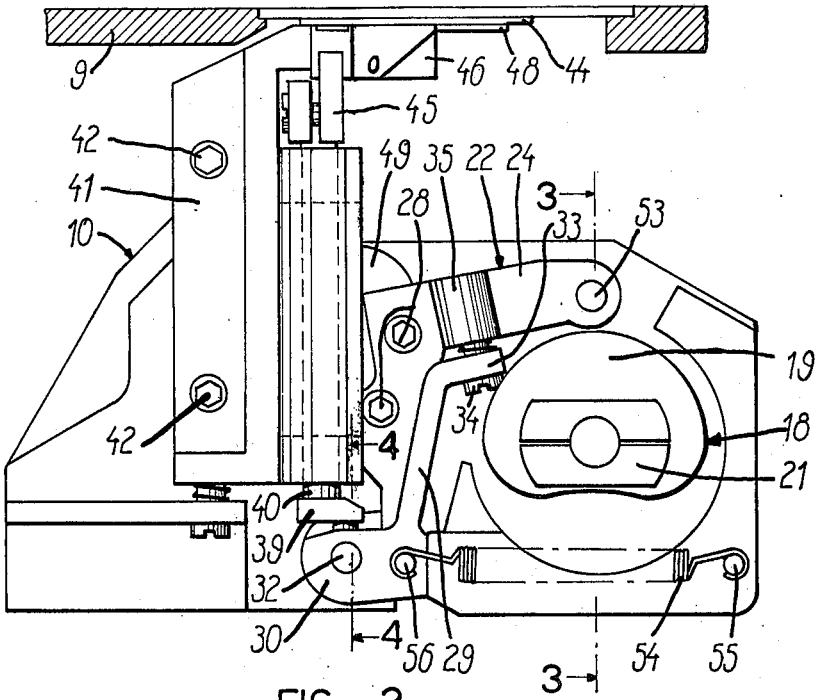
FIG. 2 is a side elevational view of the device of FIG. 1.

With reference to FIG. 1 a threads trimming apparatus defined by numeral 10 is formed from a mounting 11 fastened to a bed 9 (FIG. 2) of a sewing machine not shown in the drawings.

Mounting 11 (FIG. 3) defines a hole 8 in which a bushing 13 is fixed by means of a set screw 12, carrying a shaft 14. At one end of shaft 14 is a gear 15 fastened thereto by means of tie 20. Gear 15 is coupled to a second gear 16 indicated by a dotted line in FIG. 3, locked to the lower shaft 17 of the sewing machine.

A wall 19 whose function will be shown hereinafter is formed on cam 18 which is fixed at the other end of shaft 14, through tie 21.

With cam 18 indirectly connected, during its rotation to sewing machine main shaft 17 it is in a suitable timing connection with the hook and needle.

A cam follower 22 is placed over cam 18 and is made of magnetizable material and formed by a cylindrical portion 23 journaled at the end of two arms 24 and 25 (FIG. 1) which are the two parallel sides of a U-shaped member 26 (FIG. 5) oscillatable around pin 27 fixed to mounting 11.

A plate 29 fixed to member 27 by means of screws 28, ends in its lower part with two lugs 20 and 31 (FIGS. 1, 2 and 4) in which a seat is made for pin 32. Pin 32 is free to make axial strokes therein.

Figure 4:
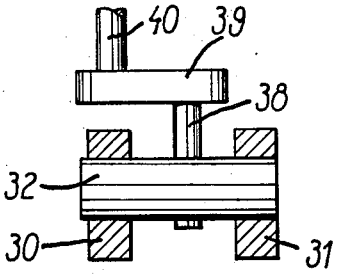
FIG. 4 is a sectional view of a detail taken along line 4—4 of FIG. 2.

Plate 29 has a projection 33 connected by means of a screw (FIG. 2) to an element 35 obtained in an intermediate point of arm 24 of U-shaped member 26. The function of screw 34 will be explained hereinafter. A hole passing transversely through pin 32 is the seat for pin 38 connected through a crank 39 to the end of a vertical shaft 40 (FIGS. 1 and 4). Shaft 40 is free to oscillate axially in a mounting 41 which is fixed by means of screws 42 to mounting 11 of the threads trimming device. Threads trimmer counterblade 44 is fixed at the upper end of mounting 41 by a screw 43 (FIG. 1).

A block 46 is integral with the upper end of shaft 40 by means of a tie 45. Threads trimming device blade 48 placed under counterblade 44 is fixed to block 46 through screw 47.

Figure 9:
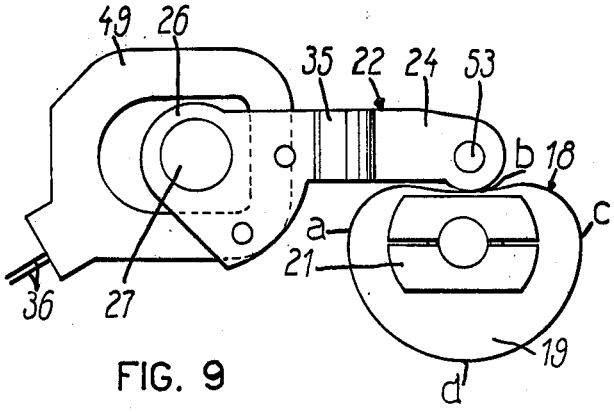

U-shaped member 26 of cam follower 22 is formed from a magnetizable material and together with cylindrical portion 23 forms a magnetic circuit energized by a coil 49 surrounding member 26. Coil 49 is formed from a copper winding buried in an insulating plastic material melting and is fastened to mounting 11 through screws not shown in the drawings. Terminals 36 of copper winding forming coil 49 (FIGS. 5, 7 and 9) are connected to a suitable 24V D.C. power source not shown in the drawings.

Figure 3:
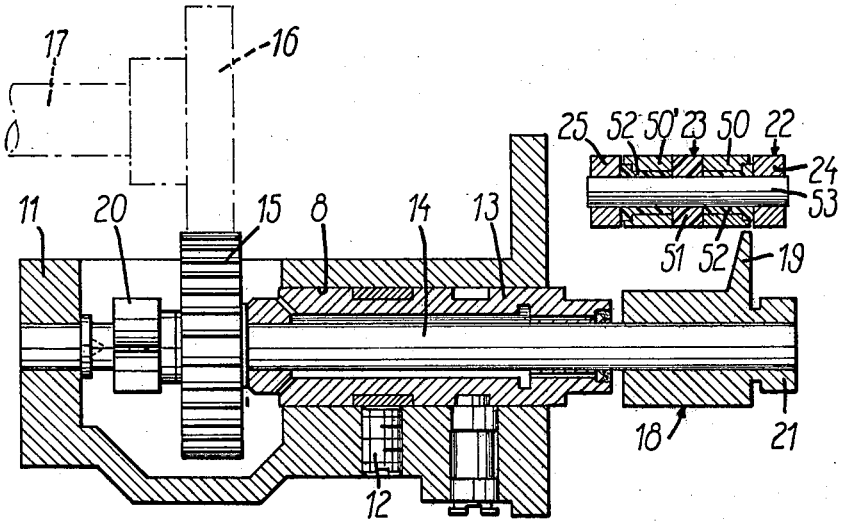
FIG. 3 is a partial sectional view taken along line 3—3 of FIG. 2.
Figure 6:
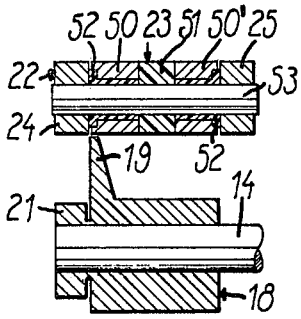
FIG. 6 is a section view taken along line 6—6 of FIG. 5.

Cylindrical portion 23 of cam follower 22 has a particular structure suggested by function and will be more particularly described with reference to FIGS. 3 and 6.

Cylindrical portion 23 is formed by two rings 50 and 50' of magnetizable material separated, the one from the other by a third ring 51 of non-magnetizable material. Rings 50 and 50' are placed onto bushings 52 of non-magnetic material. Bushings 52 and ring 51 in turn are assembled onto a pin 53 of non-magnetic material. Pin 53 is fixed to the free ends of arms 24 and 25 of U-shaped member 26.

Because of this structure a concentration of the magnetic flux lines is obtained. With rings 50 and 50' in contact with cam 18 the flux lines close and therefore an increase is obtained in the magnetic induction and consequently in the attractile force. During the sewing operation, cam 18 is in continuous rotation and cam follower 22 is kept in a raised position over cam 18 owing to the action of a coil spring 54 (FIGS. 1 and 2) fixed at one end to a pin 55 of mounting 11 and at the other to a pin 56 for plate 29.

As shown in FIGS. 5 to 10 cam 18 has portion 19 of little thickness and an arc-shaped front contour *a, b, c* concentric to the axis of rotation of the cam. Diametrically opposite to portion 19, cam 18 has an *a, b, c* portion for all its length. This portion has a particular contour suitable to impart the required motion to blade 48.

When the operator actuates the thread trimming device a suitable reader, in an appropriate timing relation, prearranges power dispatch for the energization of coil 49.

Figure 7:
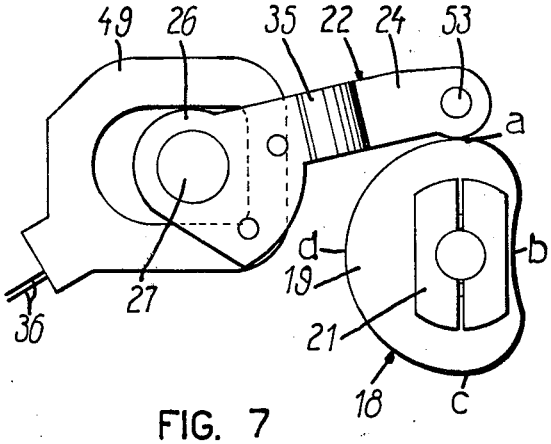
Figure 10:
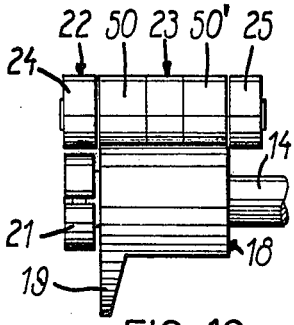

This energization takes place a little before the cam follower 24 reaches the position shown in FIG. 7 and when cam 18, during its rotation, shows the end part of portion 19 under cam follower 24. Cam follower 24 now attracted by cam 18 and when said cam will have made a further rotation to show its surface *a, b, c* to cam follower 24 (FIG. 9) will make an oscillation downwards. Plate 29, being integral with cam follower 24 and with member 26, rotates around pin 27 and causes pin 32 to oscillate. Pin 32 in turn causes a rotation of shaft 40 driving blade 48, by means of pin 38 and crank 39. Blade 48 penetrates the loop formed by the upper thread to allow said drive. Pin 32 is free to make axial displacement within the mountings formed by lugs 30 and 31.

When cam 18 has made a new angular displacement and has newly presented to cam follower 24 the beginning part of its large radius contour *a, d, c,* cam follower 24 is compelled to move towards its highest position. At this time, the loop has become closed and blade 48 makes an angular displacement the opposite direction, i.e., toward counterblade 44, to force a cutting of the thread.

Figure 5:
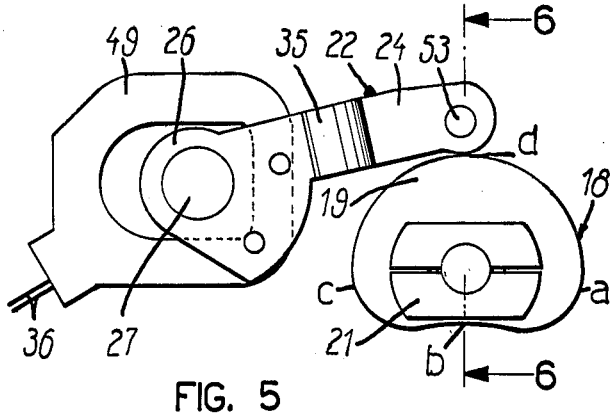
FIG. 5 is a detailed view of a portion of the device of FIG. 1 during a particular working phase.
Figure 8:
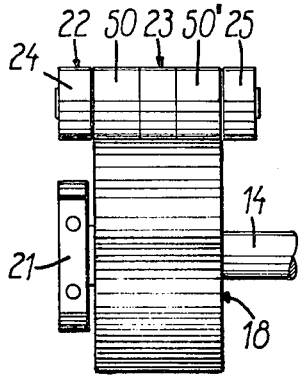
FIGS. 7 to 10 are views of the same detail of FIGS. 5 and 6 in other working phases.

Power flux to coil 49 is eliminated by the reader when cam follower 24 has come back to the position of FIG. 5. The cam follower is now kept raised by the action of spring 54.

Immediately after the cutting, the sewing machine stops with its needle out of the fabric.

For a better understanding of the reader operation and of the machine stop device, not shown in the present description, it will be useful to examine the text of U.S. Pat. No. 3,534,697 incorporated herein by reference.

Loosening screws 28 and acting on screw 34 the distance between cylindrical portion 23 and cam 18 can be adjusted, thus avoiding a contact between said members when coil 49 is not energized and at the same time avoiding such an excessive gap as to compromise the magnetic attractile effectiveness. When coil 49 is de-energized, cylindrical portion 23 must be detached from cam 18 in order to avoid a remarkable wear of rings 50 and 50′ which, owing to their specific function, can not be subjected to hardening treatment and are therefore very wearable coming into contact with other metallic material.

What is claimed is:

1. A sewing threads trimming device for sewing machines provided with a blade and a counterblade, means to operate said blade at the end of a sewing operation and in a suitable timing relation with the hook and needle movements, in a first displacement over the hook during which a thread loop closes over said blade and thereafter a second movement in the opposite direction to bring the sewing threads into contact with said counterblade and cut them, said trimming device including a cam of magnetizable material deriving its motion from the sewing machine main shaft and a cam follower, said follower being a member of a magnetic circuit, a coil linked to said follower to obtain coupling through magnetic attraction between said cam follower and said cam.

2. The sewing threads trimming device according to claim 1, in which said cam follower is comprised of a U-shaped member closed by a cylindrical portion adapted to couple with said cam and connected to a blade carrying shaft through a plate and a crank mechanism.

3. The sewing threads trimming device according to claim 2, in which said cylindrical portion of the cam follower is formed by two rings of magnetic material mounted on bushings of non-magnetic material, said rings being mounted on a pin of nonmagnetic material fixed at its free ends to said U-shaped member.

4. The sewing threads trimming device according to claim 1, in which said cam has a portion of little thickness having an arc-shaped front contour and a second portion diametrically opposite to the first having a particular contour suitable to impart the prescribed motion to the threads trimming blade.

* * * * *